US009109313B2

(12) United States Patent
Bagley

(10) Patent No.: US 9,109,313 B2
(45) Date of Patent: Aug. 18, 2015

(54) SEWING MACHINE TAKE-UP RAIL ASSEMBLY

(75) Inventor: Jim Matthews Bagley, West Valley City, UT (US)

(73) Assignee: Gracewood Management, Inc., West Valley City, UT (US)

( * ) Notice: Subject to any disclaimer, the term of this patent is extended or adjusted under 35 U.S.C. 154(b) by 764 days.

(21) Appl. No.: 13/451,227

(22) Filed: Apr. 19, 2012

(65) Prior Publication Data

US 2013/0276685 A1 Oct. 24, 2013

(51) Int. Cl.

| | |
|---|---|
| ***D05B 35/00*** | (2006.01) |
| ***D05B 11/00*** | (2006.01) |
| ***D05B 21/00*** | (2006.01) |
| ***D05B 35/04*** | (2006.01) |

(52) U.S. Cl.

CPC ..... *D05B 11/00* (2013.01); *D05B 21/00* (2013.01); *D05B 35/04* (2013.01)

(58) Field of Classification Search

CPC ..... D05B 11/00; D05B 13/00; D05B 27/02; D05D 2207/02; D05D 2207/04

USPC ..... 112/117, 118, 119, 305, 307, 313, 314, 112/470.05, 470.31

See application file for complete search history.

(56) References Cited

U.S. PATENT DOCUMENTS

| | | | | |
|---|---|---|---|---|
| 3,046,921 | A * | 7/1962 | Schwarzberger | 112/118 |
| 3,981,253 | A * | 9/1976 | Neyraud | 112/80.73 |
| 4,061,096 | A * | 12/1977 | Elsas | 112/470.12 |
| 4,192,241 | A | 3/1980 | Reed et al. | |
| 4,501,208 | A * | 2/1985 | Landoni | 112/118 |
| 4,838,187 | A * | 6/1989 | Tatum | 112/118 |
| 5,603,270 | A * | 2/1997 | White et al. | 112/117 |
| 5,913,277 | A | 6/1999 | Resta | |
| 6,123,038 | A | 9/2000 | Kames et al. | |
| 6,151,816 | A | 11/2000 | Bagley | |
| 6,237,517 | B1 * | 5/2001 | Bondanza et al. | 112/118 |
| 6,615,756 | B2 | 9/2003 | Barrus | |
| 6,631,688 | B1 | 10/2003 | Maag | |
| 6,792,884 | B1 | 9/2004 | Barrus | |
| 6,990,914 | B2 | 1/2006 | Canan | |
| 7,207,281 | B1 | 4/2007 | Kasa | |
| 7,370,591 | B2 | 5/2008 | Pfeifer | |
| 2003/0079666 | A1 | 5/2003 | Barrus | |
| 2003/0200906 | A1 | 10/2003 | Maag | |

* cited by examiner

*Primary Examiner* — Tejash Patel
(74) *Attorney, Agent, or Firm* — J. David Nelson

(57) ABSTRACT

A take-up rail assembly including a fixed idler rail and a longitudinally movable take-up rail. The fixed idler rail is attached to a quilting frame or other sewing frame and the position of the fixed idler rail may be longitudinally and vertically adjustable with respect to the sewing frame. The take-up rail is movably attached to the sewing frame and a take-up rail control mechanism moves the take up rail longitudinally forward and rearward with respect to the fixed idler rail as the sewing machine moves with respect to the sewing frame, thus providing full utilization of the throat length of the sewing machine.

7 Claims, 15 Drawing Sheets

SEWING MACHINE TAKE-UP RAIL ASSEMBLY

FIELD OF THE INVENTION

This invention is in the field of sewing machine accessories and in particular in the field of take-up rail assemblies for quilting frames.

BACKGROUND OF THE INVENTION

A quilt is usually sewn from three layers, a pre-sewn and pieced top fabric, a fabric backing bottom layer, and batting in the middle of the two fabric layers. Machine quilting is traditionally accomplished using one of two methods. For the first method, a user uses a sewing machine on a table and pushes the entire quilt around to quilt the three layers, which is cumbersome and difficult to manipulate.

For the second method, a user uses a quilting frame with a sewing or quilting machine mounted on it. For this method, the quilting frame typically consists of a system of four or five separate rails to manage the three layers of fabric. At the front of the frame there are three rails. Each rail has one of the three quilt layers of fabric rolled onto it. The three rails feed the three layers of fabric sandwiched together to the take up rail, located toward the back of the frame. On some frames the fabric layers first pass under an idler rail and then up to the take up rail. The idler rail serves to position the fabric just above the bed or bottom of the throat of the sewing machine so the fabric does not drag on the bed of the machine as the machine is moved around on the quilt to create the quilted patterns on the fabric. When no idler rail is present, the take up rail must be repositioned higher in relation to the bed of the machine to prevent the fabric from dragging on the bed of the machine as the quilted fabric is gradually rolled up on the take up rail, gradually growing in diameter. The present invention requires the use of an idler rail.

The back half of the frame consists of a framework that holds the sewing machine on a wheeled plate (or the sewing machine has wheels mounted directly to it and therefore serves as the top plate itself) that rolls in an X axis which sits on a second wheeled plate that rolls on the framework in a Y axis. The sewing machine or the top plate will have a set of handles that gives the user the ability to move the sewing machine smoothly across the quilt fabric layers to stitch them together. The take up rail passes through the throat of the sewing machine and is used to roll up the fabric layers once they have been quilted together with the sewing machine.

The size of the patterns that a user can sew on the quilt at one time is limited by the length of the throat of the sewing machine and by the diameter of the quilted roll of fabric layers that is located in the throat of the sewing machine. The length of the throat of the sewing machine is equal to the distance from the back of the throat of the machine to the sewing needle. If a sewing machine has a throat size of 18 inches and the take up rail and idler rail diameters are the typical 1.5 inches, then the maximum size pattern that could be quilted would be 16.5 inches assuming the needle could sew right to the edge of the rail. Once the available area of quilt has been sewn, the sewn area of fabric is rolled onto the take up rail. Depending on the thickness of batting and the length of the quilt, the roll of quilted fabric can be as large as 6 inches or even larger. So, as the user finishes the quilt and there is approximately a six inch diameter roll of fabric passing through the machine, the effective quiltable area has become only 12 inches. This must be accounted for as a user plans their quilt from the beginning, so that they do not plan to use 14 inch patterns, which are feasible at the beginning of the quilt, but impossible at the end of the quilt when the maximum size pattern is 12 inches.

The present invention is intended to remedy this problem. With the use of a stationary idler rail and a take up rail that moves longitudinally, i.e. forward and back, as the sewing machine approaches the take up rail at the needle side or back side of the throat of the machine, the user will have the same available quilting area throughout the quilt regardless of the size of the roll of fabric passing through the throat of the machine. Having the take up rail move in relationship to the idler rail gives the user the ability to quilt the maximum area that the throat of the sewing machine will allow from the beginning of the quilt to the end of the quilt. Thus, with the same 18 inch throat sewing machine, the present invention gives the user the ability to sew 16.5 inch patterns all the way through the quilt rather than being limited to 12 inches when the finished roll of quilted material is six inches. With the present invention, the user can quilt the same size patterns with an 18 inch throat machine that would have previously required a 22.5 inch throat sewing machine.

An objective of the present invention is to provide a take-up rail assembly which will increase the usable throat length of a sewing machine, and in particular a quilting machine.

A further objective of the present invention is to provide a take-up rail assembly which will increase the usable throat length of a sewing machine and continue to provide increased throat length as sewed fabric, e.g., quilted material, is rolled onto the take-up rail and the diameter of the roll of sewed fabric increases.

SUMMARY OF THE INVENTION

In the case of a typical quilting sewing operation, the fabric layers consist of a quilt front, a quilt back, and backing material. The take-up rail assembly of the present invention includes a fixed idler rail and a longitudinally movable take-up rail. The fixed idler rail, the position of which may be longitudinally and vertically adjustable with respect to the quilting frame, is attached or attachable to a quilting frame. As the sewing machine moves from a machine full forward position to a machine full back position, and the fixed idler rail moves from an idler rail full back position to an idler rail full forward position, with respect to the sewing machine, the take-up rail, which is movably attached or attachable to the quilting frame, moves longitudinally rearward, with respect to the fixed idler rail, from a take-up rail full forward position to a take-up rail full back position. As the sewing machine moves from the machine full back position to the machine full forward position, the fixed idler rail moves, with respect to the sewing machine, from the full forward position to the full back position, and the take-up rail moves longitudinally forward, with respect to the fixed idler rail, from the take-up rail full back position to the take-up rail full forward position. The forward and rearward longitudinal movement of the take-up rail provides for full idler rail travel from the full forward position to the full back position and thus the full utilization of the throat of the sewing machine regardless of the amount of fabric which has been rolled on the take-up rail, until the take-up rail is fully loaded with fabric.

It will be noted that some of the embodiments shown in the drawings and described in this specification provide for the longitudinal movement of the take-up rail by pivoting of the take-up rail about a take-up rail pivot axis. For those embodiments, longitudinal movement of the take-up rail is accomplished by movement of the take-up rail along an arc centered on a take-up rail pivot axis. As a result, the movement of the take-up rail, for those embodiments, has a vertical component as well as the desired longitudinal component. For purposes of this application, the term "longitudinal movement", when referring to the take-up rail, shall be defined to include movement of the take-up rail, with respect to the fixed idler rail, having a longitudinal component, whether or not the take-up rail movement also has a vertical component due to the pivoting or other movement of the take-up rail resulting from the overall structure of the take-up rail assembly.

For embodiments which provide for longitudinal movement of the take-up rail by providing for pivoting of the take-up rail, the take-up rail assembly may provide for the take-up rail to pivot about a take-up rail pivot axis centered on the axis of the fixed idler rail or displaced from axis of the fixed idler rail. By selecting a pivot radius of a displaced take-up rail pivot axis, pivoting of the take-up rail can be accomplished which will maintain a take-up force on the fabric on the take-up rail while preserving the maximum travel of the fixed idler rail. For the pivoting embodiments, the take-up rail may be pivotally attached to a quilting frame by a pair of take-up rail pivot arms. A pivot control mechanism controls the movement of the take-up rail pivot arm and the take-up rail pivoting.

For pivoting embodiments which have a pivot control mechanism, as well as other embodiments having other types of take-up rail control mechanisms, the movement and positioning of the take-up rail may be controlled based upon the position of the idler rail as it moves between the idler rail full back position and the idler rail full forward position, which may be determined by idler rail position sensors. The take-up rail pivot control mechanism or other take-up rail control mechanism may also control the movement and positioning of the take-up rail based upon contact of the fabric roll with the forward throat edge and the rearward throat edge. A pivot control mechanism or other take-up rail control mechanism may be linked to a computerized sewing machine control system which controls the movement of the sewing machine on a quilting frame or other sewing frame.

Preferred embodiments of the take-up rail assembly of the present invention may incorporate a compound fixed idler rail having a first idler rail shaft and a second idler rail shaft. The fabric is clamped between the first idler rail shaft and the second idler rail shaft, and may be coiled on the compound fixed idler rail so as to maintain a desired tension on the fabric and thereby maintain the desired positioning and tension of the fabric as sewing occurs.

Preferred embodiments of the take-up rail assembly may be attached to a typical stationary quilting frame, which provides for the longitudinal and lateral movement of the sewing machine with respect to the stationary quilting frame. A typical quilting frame may be equipped with a sewing machine carriage movably attached to the frame, to which a sewing machine may be mounted. The controlled movement of the sewing machine carriage on the quilting frame may provide for the movement of the sewing machine as required to sew a desired pattern. However, other preferred embodiments of the take-up rail assembly may be attached to a moving quilting frame which moves with respect to a stationary sewing machine as required for the sewing machine to sew a pattern in the fabric or layers of fabric being sewn.

An alternative embodiment of a take-up rail assembly of the present invention may provide for take-up rail longitudinal movement by a take-up rail axle sliding longitudinally, i.e. forward and rearward, in a slide track which is attached to the quilting frame. Other variations of a take-up rail control mechanism may provide for sliding or otherwise moving the take-up rail longitudinally between the full back position and the full forward position. Such take-up rail control mechanisms may include a piston or screw drive.

A further embodiment of the take-up rail assembly provides for longitudinal movement of the take-up rail with respect to the fixed idler rail by providing for forward and rearward movement of a pair of take-up rail support members to which the take-up rail is attached, one on each end of the take-up rail. The take-up rail support members may have a support member projection which may reduce or eliminate conflict between the idler rail and the take-up rail as the take-up rail moves between the take-up rail full back position and the take-up rail full forward position.

A preferred embodiment of a drive mechanism for this embodiment of the take-up rail assembly may provide for each of the take-up rail support members to be attached to an anchor member having a first roller and a second roller which provide for movement of the anchor member on a roll track and for movement of the take-up rail support member and the take-up rail. A take-up cam may provide for positioning of the anchor member and the support member by cam contact with a cam bar which is connected to the anchor member. Cam contact between the take-up cam and the cam bar may be maintained by a cam retainer device, such as cam spring, a pressurized gas cylinder, or other device known to persons of skill in the art. An alternative preferred embodiment of a drive mechanism for this embodiment of the take-up rail assembly may incorporate a screw drive which is rotated by a drive motor and threaded through a screw sleeve which is connected to the anchor member and the take-up rail support member, thereby providing for the desired movement of the take-up rail.

Other embodiments and variations of a take-up rail control mechanism which provide for moving the take-up rail longitudinally between the full back position and the full forward position may utilize a cam drive, a screw drive, a hydraulic ram, a solenoid, or other drive mechanisms known to persons skilled in the art.

As noted above, embodiments of the take-up rail assembly of the present invention may incorporate an idler rail which is vertically and horizontally adjustable, allowing the vertical and horizontal adjustment of the idler rail to match the sewing machine, or the fabric being sewed, or both. Accordingly, where the term "fixed" idler rail is used in this application, the term is defined to include embodiments wherein the user may vertically or horizontally adjust the position of the idler rail and "fix" the idler rail in the position desired by the user or needed for the sewing machine or fabric, or both, being used.

It must also be noted that, although preferred embodiments of the take-up rail assembly of the present invention are described as attached or attachable to a typical quilting frame, and used for quilting of multiple fabric layers, other embodiments of the take-up rail assembly of the present invention may be attached or attachable to sewing frames used for embroidery or other sewing operations involving a single fabric layer or multiple fabric layers.

DETAILED DESCRIPTION OF PREFERRED EMBODIMENTS

Figure 1:
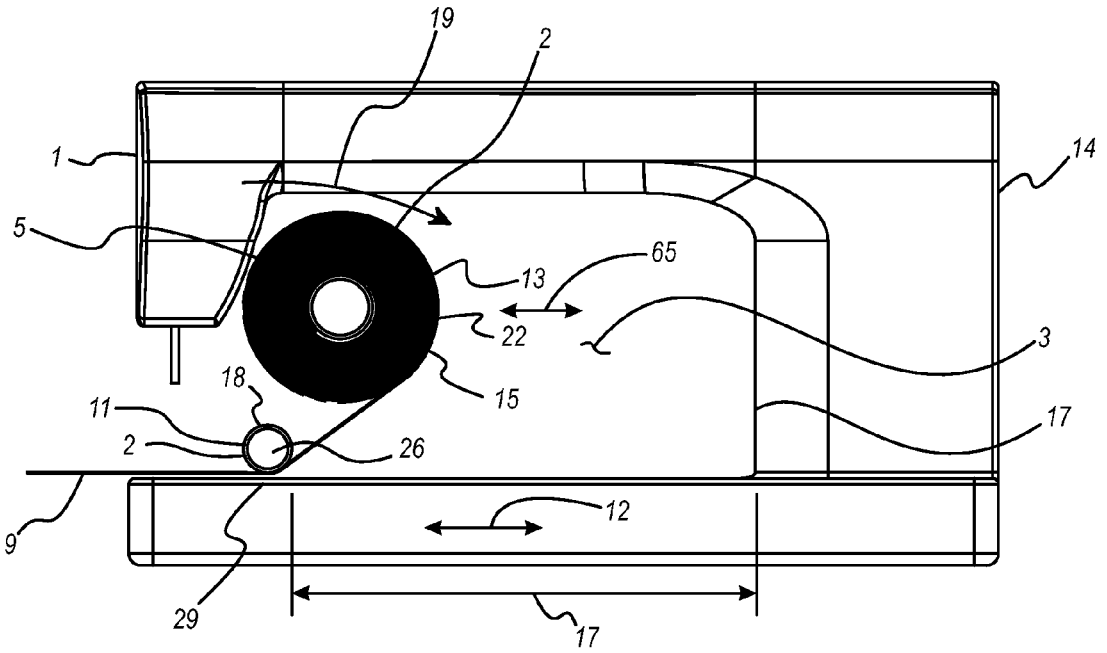
FIG. 1 is a side view cross section of a preferred embodiment of a take-up rail assembly of the present invention deployed with a typical sewing machine, the sewing machine being in a machine full back position, the fixed idler rail being at a fixed rail full forward position, and the take-up rail being at a take-up rail full back position.
Figure 9:
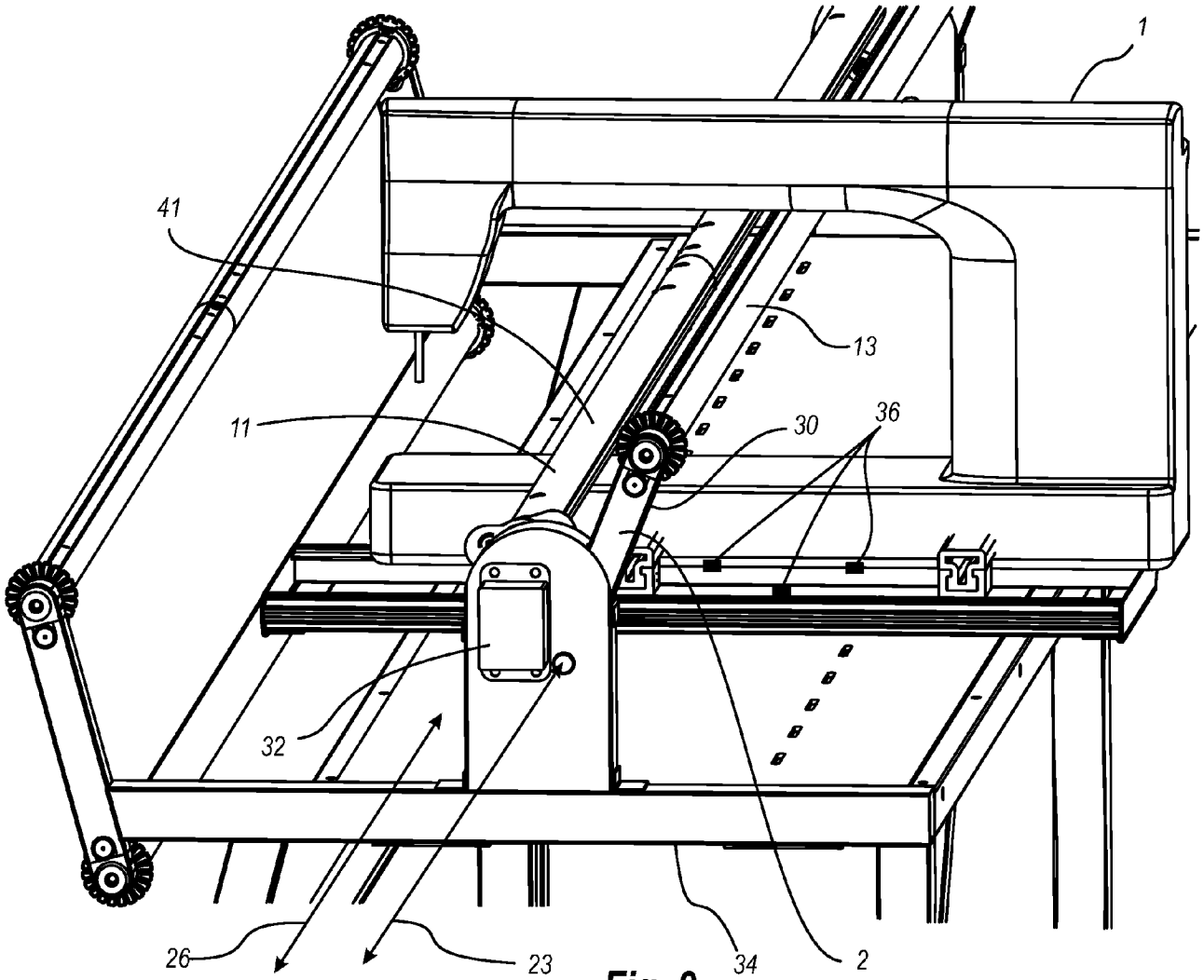
FIG. 9 is a side view perspective of a preferred embodiment of the take-up rail assembly of the present invention having a take-up rail pivotally attached to a quilting frame by a pair of pivot arms, a pivoting mechanism connected to one of the pivot arms, and a compound fixed idler rail.

Referring first to FIG. 1, a side view cross section of a preferred embodiment of a take-up rail assembly 2 of the present invention deployed with a typical sewing machine 1 is shown. The sewing machine 1 illustrated is a typical quilting machine which may be mounted on a quilting frame 34, an embodiment of which is shown in FIG. 9, which provides for back and forth longitudinal movement 12 as well as lateral movement of the sewing machine, as the sewing operation is under way, thereby providing for the sewing machine to sew a pattern in the fabric or layers of fabric 9 being sewn.

In the case of a typical quilting sewing operation, the fabric layers 9 consist of a quilt front, a quilt back, and backing material. The take-up rail assembly 2 illustrated in FIG. 1 includes a fixed idler rail 11 and a longitudinally movable take-up rail 13. For the preferred embodiment shown in FIG. 1, take-up rail longitudinal movement 65 is provided by pivoting of the take-up rail 19,21 as also illustrated in FIGS. 3-8. In FIG. 1 the sewing machine 1 is in the machine full back position 14 with the fixed idler rail 11 at the fixed rail full forward position 18, with respect to the sewing machine 1. Referring also to FIG. 9, the fixed idler rail 11 is attached to a quilting frame 34, an embodiment of which is illustrated in FIG. 9, and is free to only rotate as the sewing machine 1 moves from the machine full back position 14 to the machine full forward position 16 shown in FIG. 2, where the fixed idler rail 11 is at the fixed rail full back position 20, with respect to the sewing machine 1.

Referring again to FIG. 1, the take-up rail is shown with a fabric roll 15 at or near its maximum capacity. As the sewing machine 1 moves from the machine full forward position 16 shown in FIG. 2 to the machine full back position 14 shown in FIG. 1, and the fixed idler rail 11 moves from the idler rail full back position 20 shown in FIG. 2 to the idler rail full forward position 18 shown in FIG. 1, the take-up rail pivots rearward 19, with respect to the fixed idler rail 11, from the take-up rail full forward position 24 shown in FIG. 2, to the take-up rail full back position 22 shown in FIG. 1. As the sewing machine 1 moves from the machine full back position 14 shown in FIG. 1 to the machine full forward position 16 shown in FIG. 2, the fixed idler rail 11 moves from the full forward position 18 shown in FIG. 1 to the full back position 20 shown in FIG. 2, and the take-up rail 13 pivots forward 21, with respect to the fixed idler rail 11, from the take-up rail full back position 22 shown in FIG. 1 to the take-up rail full forward position 24 shown in FIG. 2. The forward pivoting 21 and the rearward pivoting 19 of the take-up rail provides for full idler rail travel 17 from the full forward position 18 to the full back position 20 and thus the full utilization of the throat 3 of the sewing machine regardless of the amount of fabric 15 which has been rolled on the take-up rail, until the take-up rail is fully loaded with fabric. The fabric layers 9 are positioned upon and slide upon the machine throat base 29 as the sewing machine moves between the machine full forward position 16 and the machine full back position 14.

Figure 2:
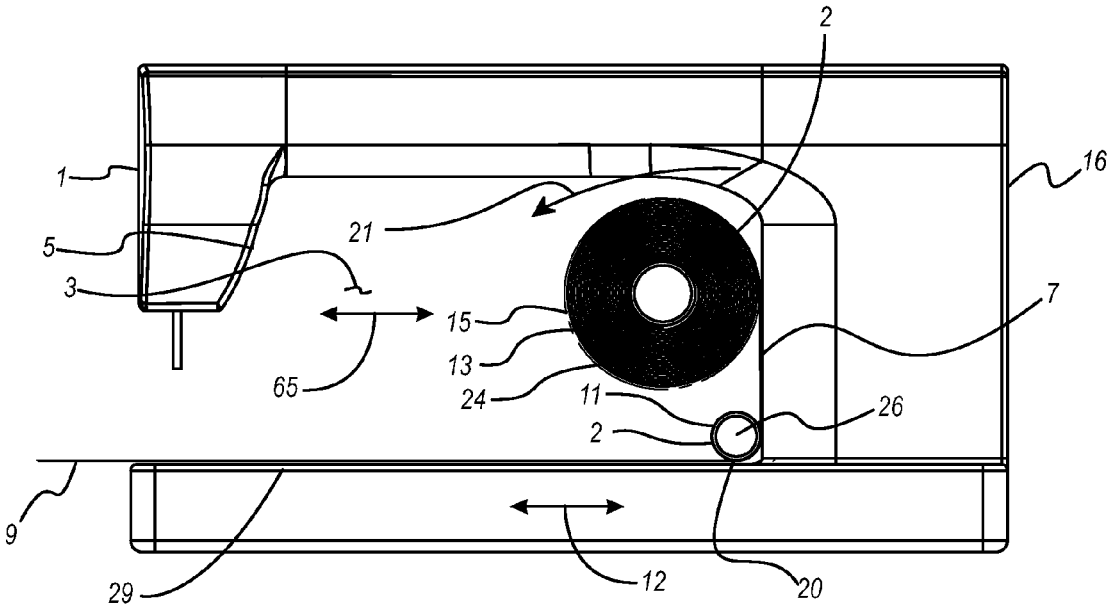
FIG. 2 is a side view cross section of a preferred embodiment of a take-up rail assembly of the present invention deployed with a typical sewing machine, the sewing machine being in a machine full forward position, the fixed idler rail being at a fixed rail full back position, and the take-up rail being at a take-up rail full forward position.

The embodiment of the take-up rail assembly shown in FIG. 1 and FIG. 2 provide for the take-up rail to pivot about an axis centered on the axis 26 of the fixed idler rail.

Figure 3:
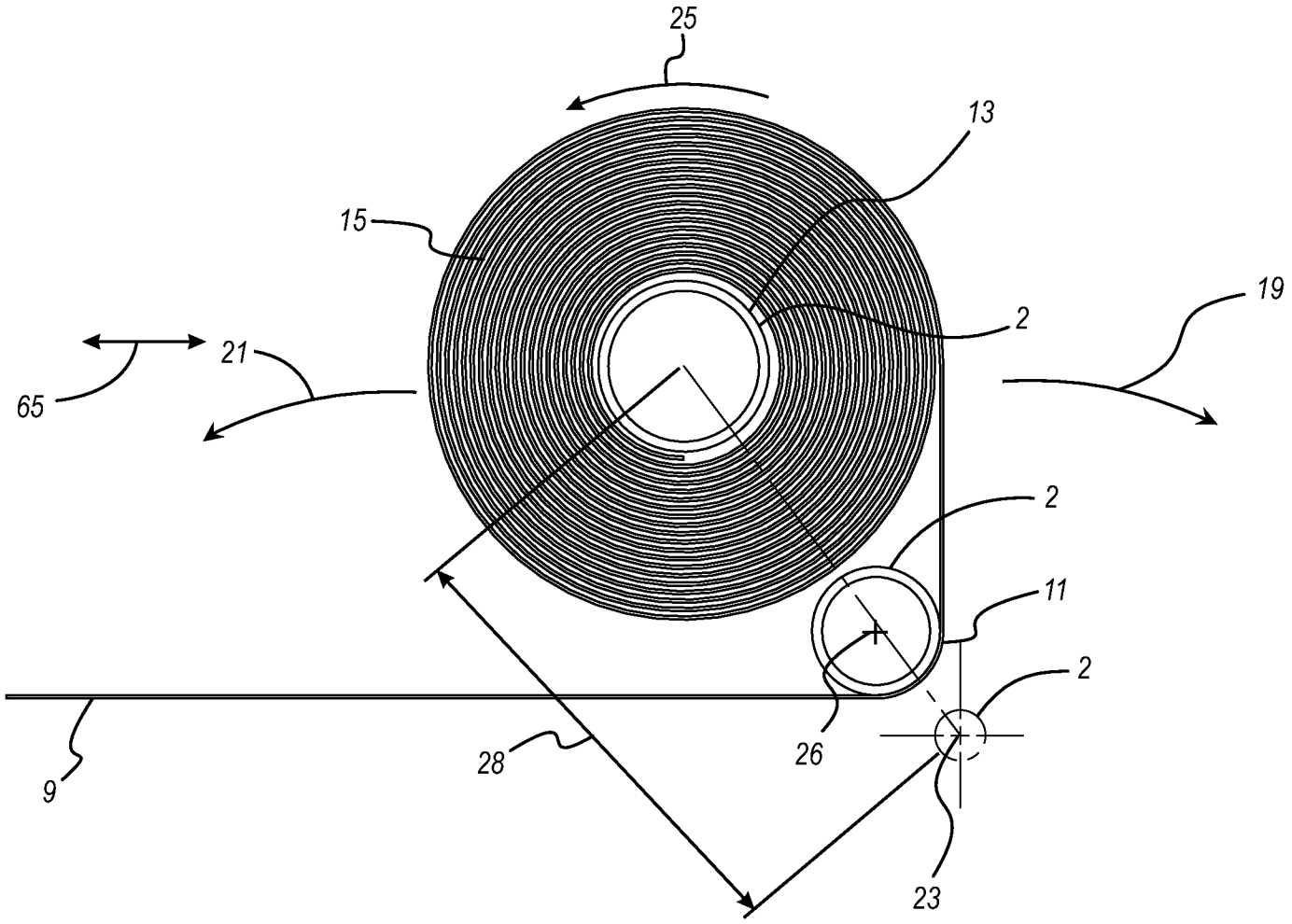
FIG. 3 illustrates a side view cross section of an alternative embodiment of the take-up rail assembly which has a take-up rail pivot axis displaced below and behind the idler rail axis.

Referring now to FIG. 3, an alternative embodiment of the take-up rail assembly 2 provides for a take-up rail pivot axis 23 to be displaced below and behind the idler rail axis 26. The pivot radius 28 of the displaced take-up rail pivot axis 23 of this embodiment provides for pivoting 19, 21 of the take-up rail while maintaining the take-up force 25 on the fabric 15 on the take-up rail 13 while preserving the maximum travel 17 of the fixed idler rail shown in FIG. 2.

FIG. 9 illustrates a quilting frame 34 with a take-up rail pivot arm 30 which has a take-up rail pivot axis 23 displaced from the fixed idler rail axis 26. The take-up rail embodiment shown is pivotally attached to a quilting frame 34 by the take-up rail pivot arm 30. A pivot control mechanism 32 controls the movement of the take-up rail pivot arm 30 and the take-up rail pivoting 19, 21 as shown in FIG. 3.

Figure 4:
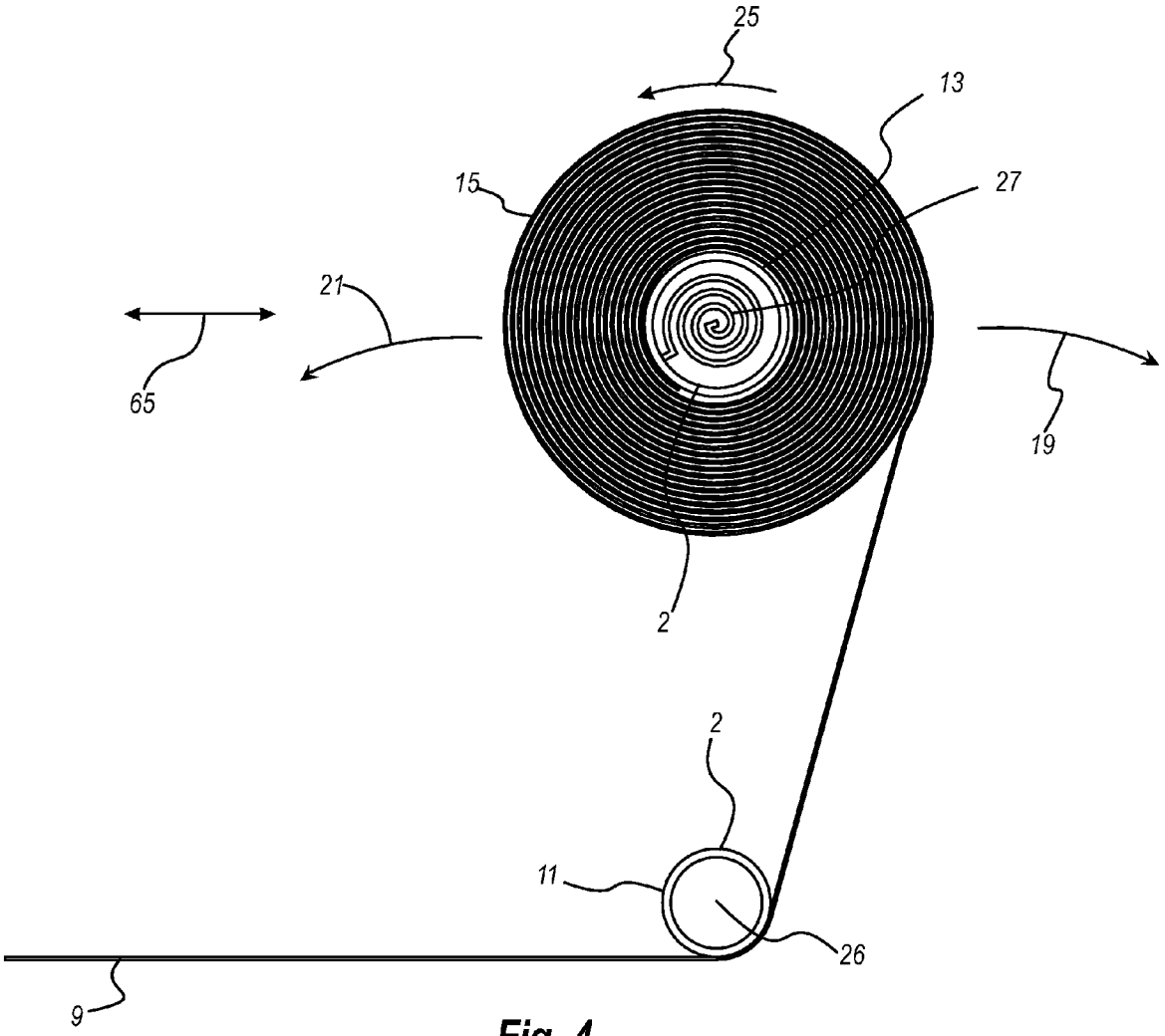
FIG. 4 illustrates a side view cross section of an alternative embodiment of the take-up rail assembly of the present invention having a coil spring which imparts a fabric take-up force on the take-up rail and the fabric roll.

FIG. 4 illustrates an alternative embodiment of the take-up rail assembly 2 of the present invention which provides for the take-up rail to pivot about the fixed idler rail axis 26 while a coil spring 27 imparts a fabric take-up force 25 on the take-up rail 13 and the fabric roll 15 thereby maintaining tension 55 on the fabric 9 as the sewed fabric is coiled onto the take-up rail 13 and resisting uncoiling of the fabric 9 from the take-up rail 13.

Figure 5:
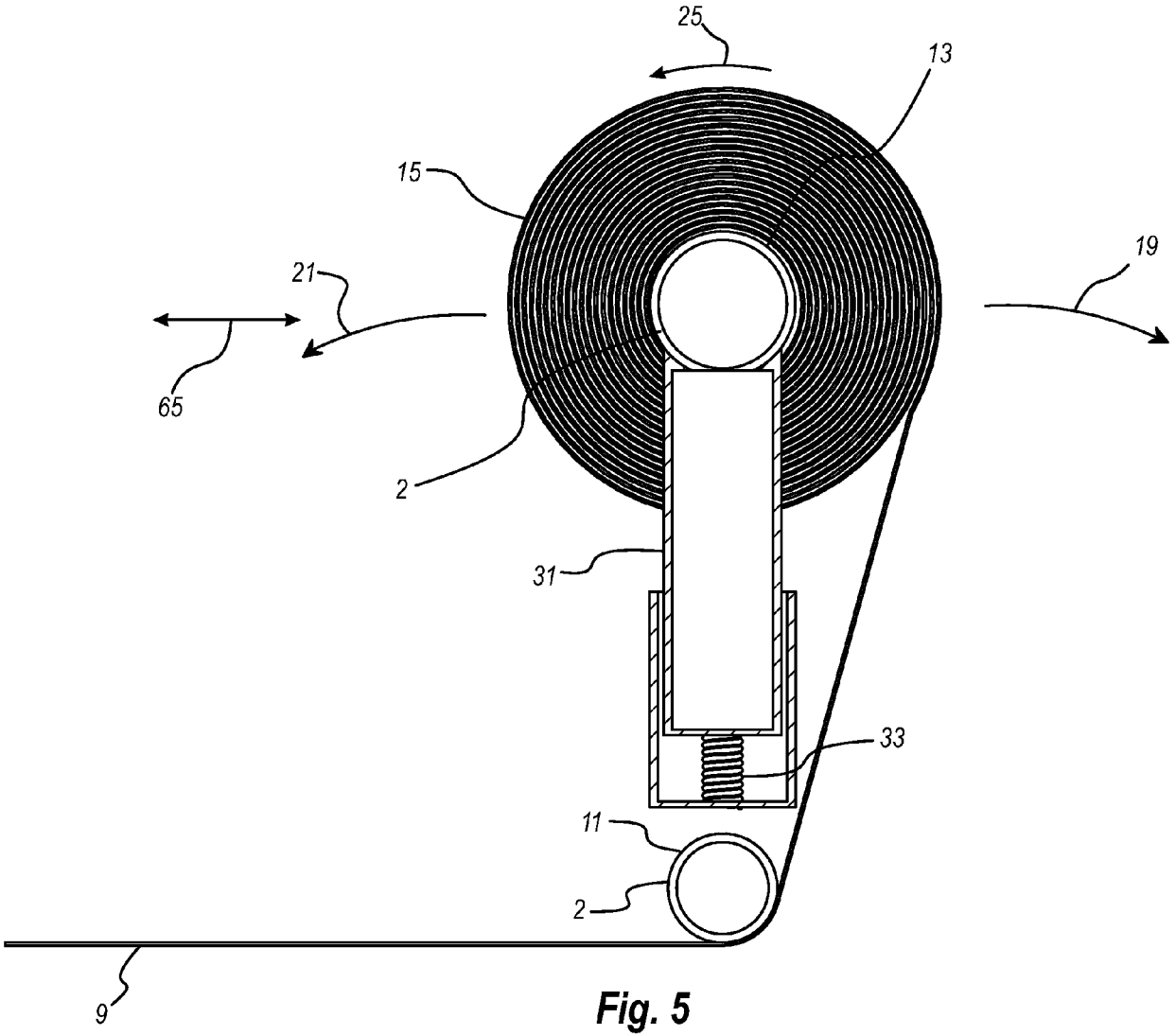
FIG. 5 illustrates a side view cross section of an alternative embodiment of the take-up rail assembly of the present invention having a compression spring and a tension piston which causes the tension piston to exert a fabric take-up force on the take-up rail.
Figure 6:
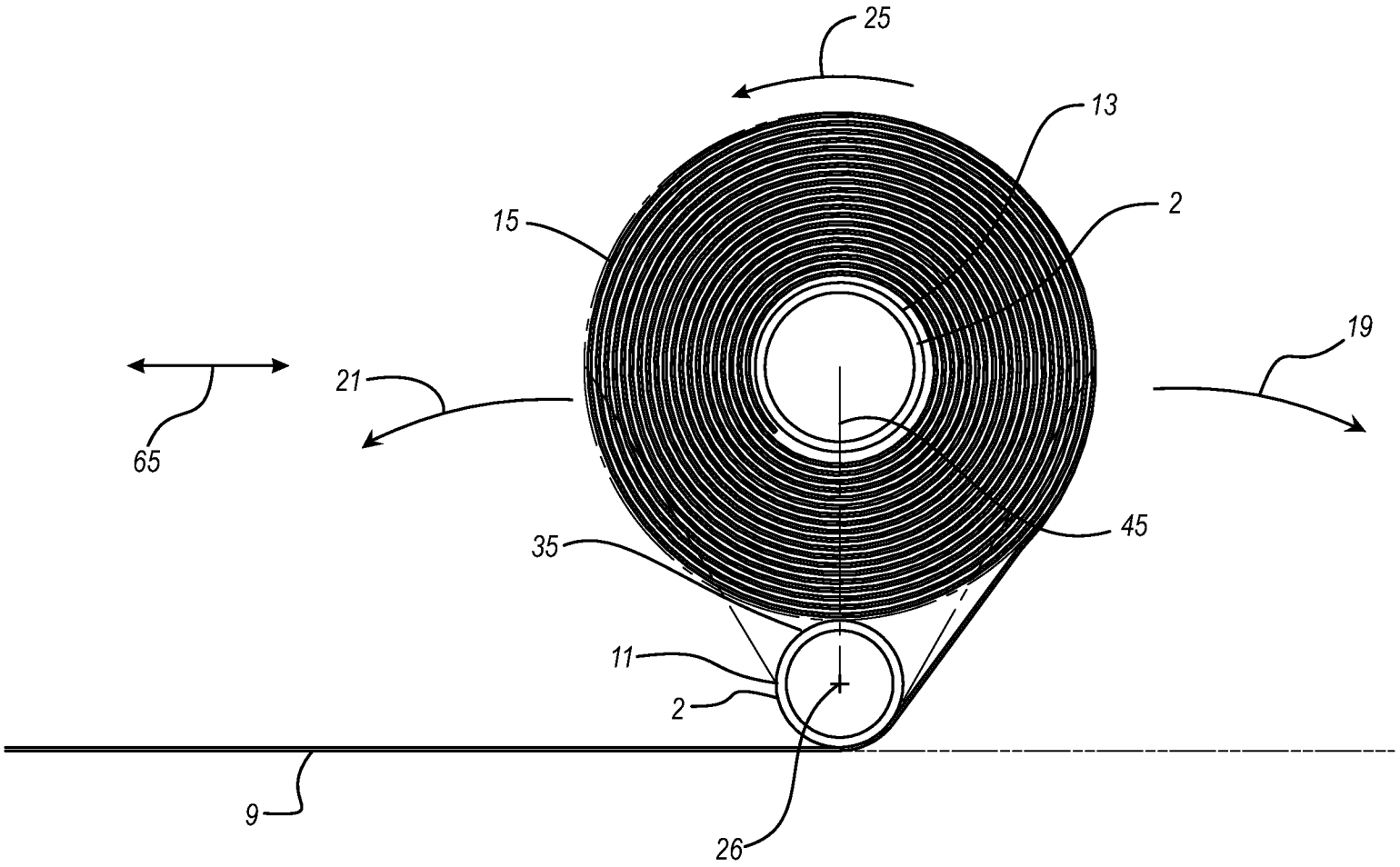
FIG. 6 illustrates a side view cross section of an alternative embodiment of the take-up rail assembly of the present invention which provides for a variable pivot radius with the take-up rail pivot axis coinciding with the fixed idler rail axis and for physical contact between the fabric roll and the fixed idler rail.

Referring now to FIG. 5, for this embodiment a compression spring 33 causes a tension piston 31 to exert a fabric take-up force 25 on the take-up rail 13 thereby resisting the uncoiling of the fabric roll 15. Referring now to FIG. 6, this embodiment of the take-up rail assembly 2 of the present invention provides for a variable pivot radius 45 with the take-up rail pivot axis 46 coinciding with the fixed idler rail axis 26. The take-up rail pivot radius 45 increases as fabric is rolled onto the fabric roll 15 thereby increasing the diameter of the fabric roll. Physical contact 35 between the fabric roll 15 and the fixed idler rail 11 serves to resist the unrolling of the fabric 9 from the fabric roll 15.

Figure 7:
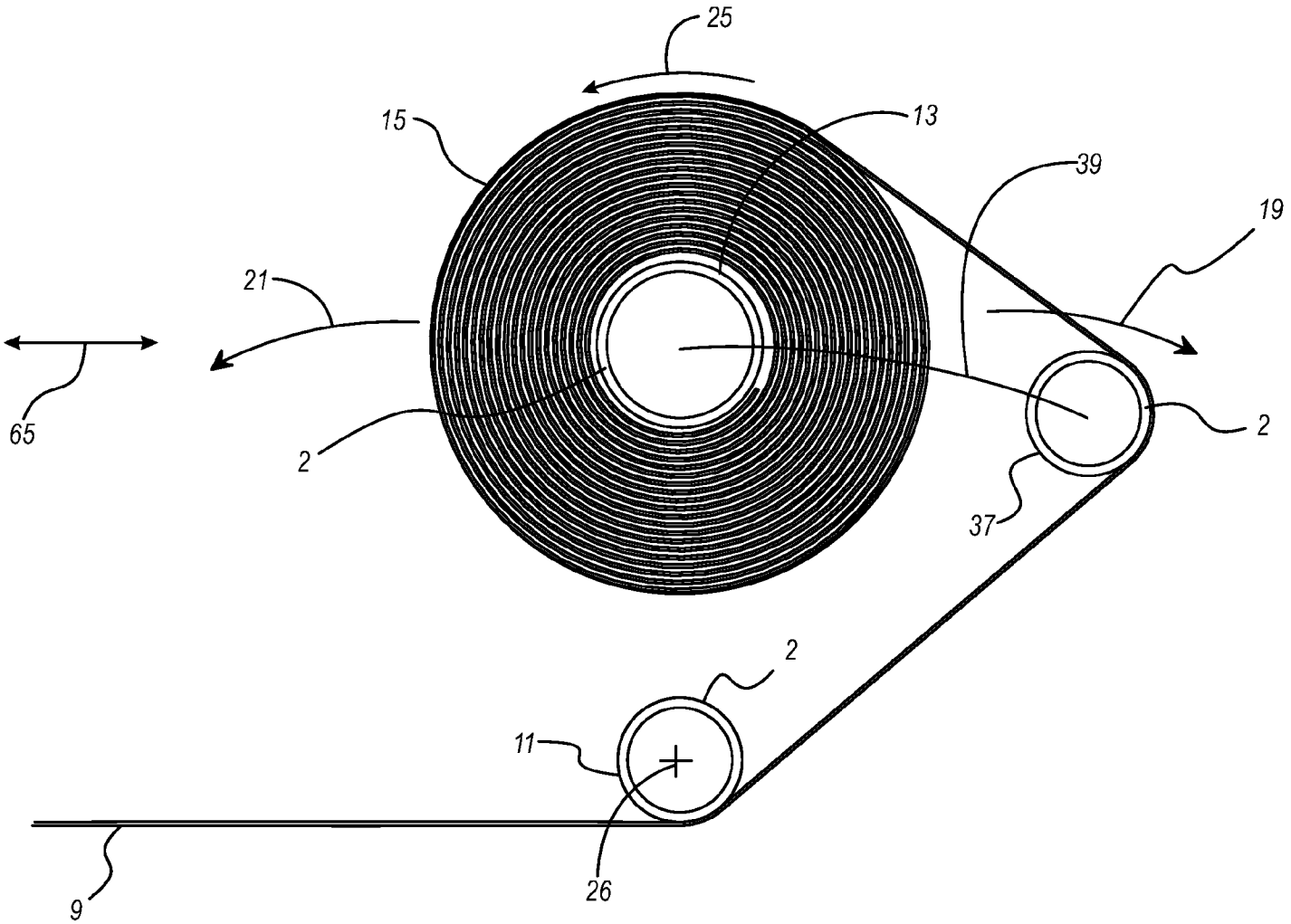
FIG. 7 illustrates a side view cross section of an alternative embodiment of the take-up rail assembly of the present invention which has a pivoting idler rail in addition to a fixed idler rail.

Referring now to FIG. 7, this embodiment of the take-up rail assembly 2 of the present invention has a pivoting idler rail 37 in addition to the fixed idler rail 11. For this embodiment the take-up rail pivot axis 46 and the moving idler rail pivot axis 48 may pivot 39 about the idler rail axis 26 or pivot about a take-up rail pivot axis 23 displaced from the idler rail axis 26 as illustrated in FIG. 3.

Figure 8:
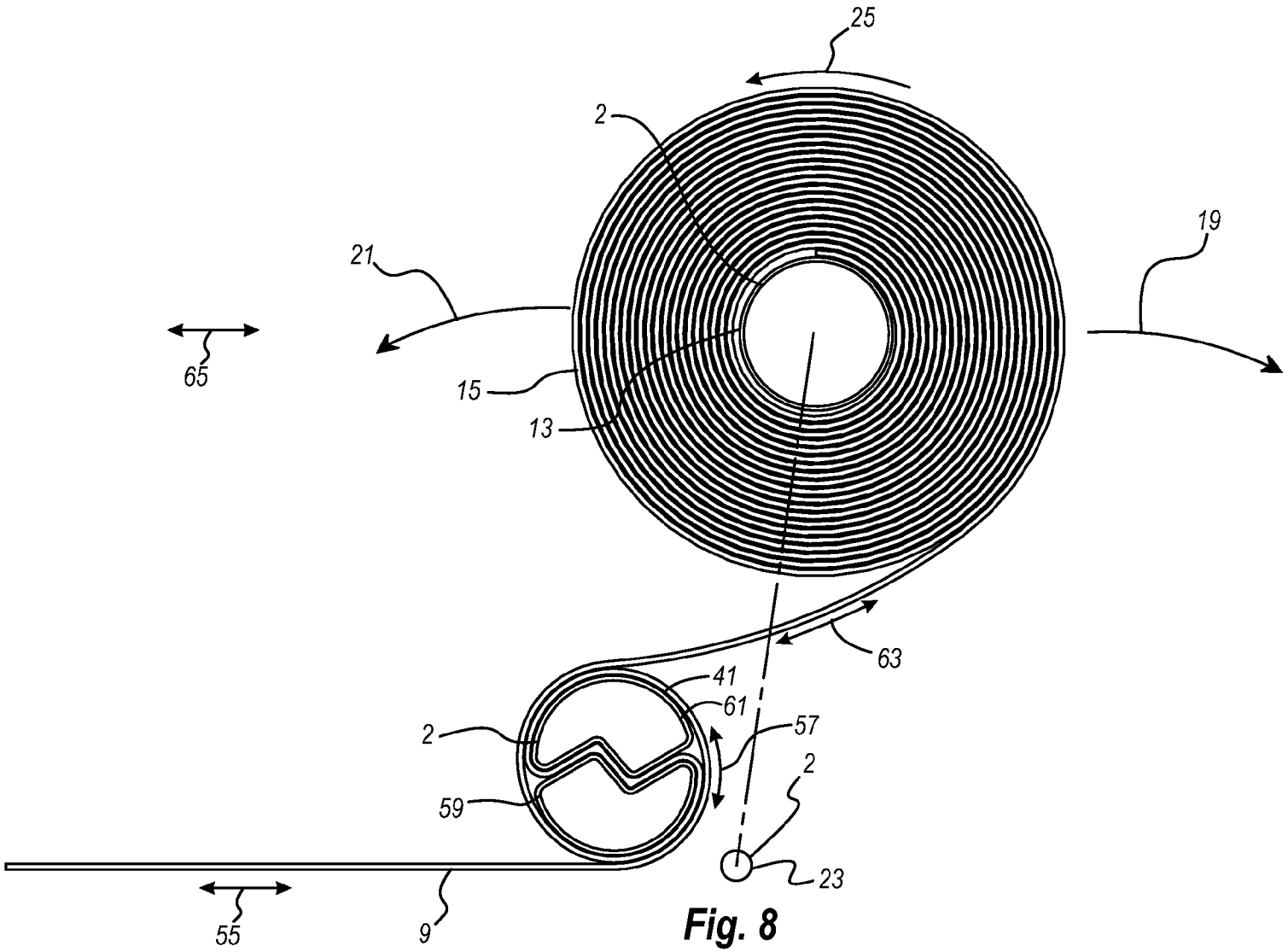
FIG. 8 illustrates a side view cross section of a further embodiment of the take-up rail assembly of the present invention which has a compound fixed idler rail.

Referring now to FIG. 8, a further embodiment of the take-up rail assembly 2 of the present invention is shown which has a compound fixed idler rail 41 which serves to clamp the fabric 9 and serves to resist the uncoiling of the fabric 9 from the fabric roll 15 and maintain tension 55 in the fabric 9. The fabric 9 is clamped between a first idler rail shaft 59 and the second idler rail shaft 61, and may be coiled 57 on the compound fixed idler rail 41 as to maintain the desired tension 55 on the fabric 9 and thereby maintain the desired positioning and tension of the fabric 9 as sewing occurs. Because the fixed idler rail maintains the tension and positioning of the fabric for sewing for this embodiment, the take-up rail fabric tension 63 of the fabric between the compound fixed idler rail 41 and the take-up rail 13 is unimportant for this embodiment.

Referring again to FIG. 9, the take-up rail pivoting 19,21 by the take-up rail pivot arm 30, whether the take-up rail pivot axis 23 is displaced from the axis of the idler rail axis 26 as shown in FIG. 9, or is centered on the idler rail axis 26 as shown in FIGS. 1 and 2, may be controlled by a pivot control mechanism 32 based upon the position of the idler rail 11 as it moves between the idler rail full back position 20 shown in FIG. 2 and the idler rail full forward position 18 shown in FIG. 1, which may, for a preferred embodiment, be determined by idler rail position sensors 36 as shown in FIG. 9. The pivot control mechanism 32 may also control the pivoting of the take-up rail pivot arm 30 based upon contact of the fabric roll 15 with the forward throat edge 5 and the rearward throat edge 7 as shown in FIG. 1 and FIG. 2 respectively.

It should be noted that the preferred embodiments of the take-up rail assembly 2 illustrated in the FIGS. 1-8 may be attached to a typical stationary quilting frame 34 or other sewing frame as shown in FIG. 9, which provides for the longitudinal and lateral movement of the sewing machine with respect to the stationary quilting frame 34 or other sewing frame. A typical quilting frame or other sewing frame may be equipped with a sewing machine carriage movably attached to the frame, to which a sewing machine may be mounted. The controlled movement of the sewing machine carriage on the quilting frame or other sewing frame may provide for the movement of the sewing machine as required to sew a desired pattern. However, other preferred embodiments of the take-up rail assembly 2 may be attached to a moving quilting frame or other sewing frame which moves with respect to a stationary sewing machine as required for the sewing machine to sew a pattern in the fabric or layers of fabric 9 being sewn. Therefore, where movement or travel of the take-up rail assembly 2 of preferred embodiments, including movement or travel of the fixed idler rail or the take-up rail, of the present invention is described in the specification or the claims, it may refer to movement or travel of the sewing machine on a stationary quilting frame to which the take-up rail assembly is attached, or may refer to actual movement of the quilting frame or other sewing frame and the attached take-up rail assembly with respect to a stationary sewing machine. Movement or travel of the take-up rail assembly refers to movement or travel of the take-up rail assembly relative to, or with respect to, the sewing machine. The longitudinal movement of the take-up rail by the take-up rail control mechanism refers to movement or travel of the take-up rail with respect to the fixed idler rail and to the sewing frame, whether the sewing machine moves with respect to a stationary sewing frame or the sewing frame moves with respect to a stationary sewing machine.

Figure 10:
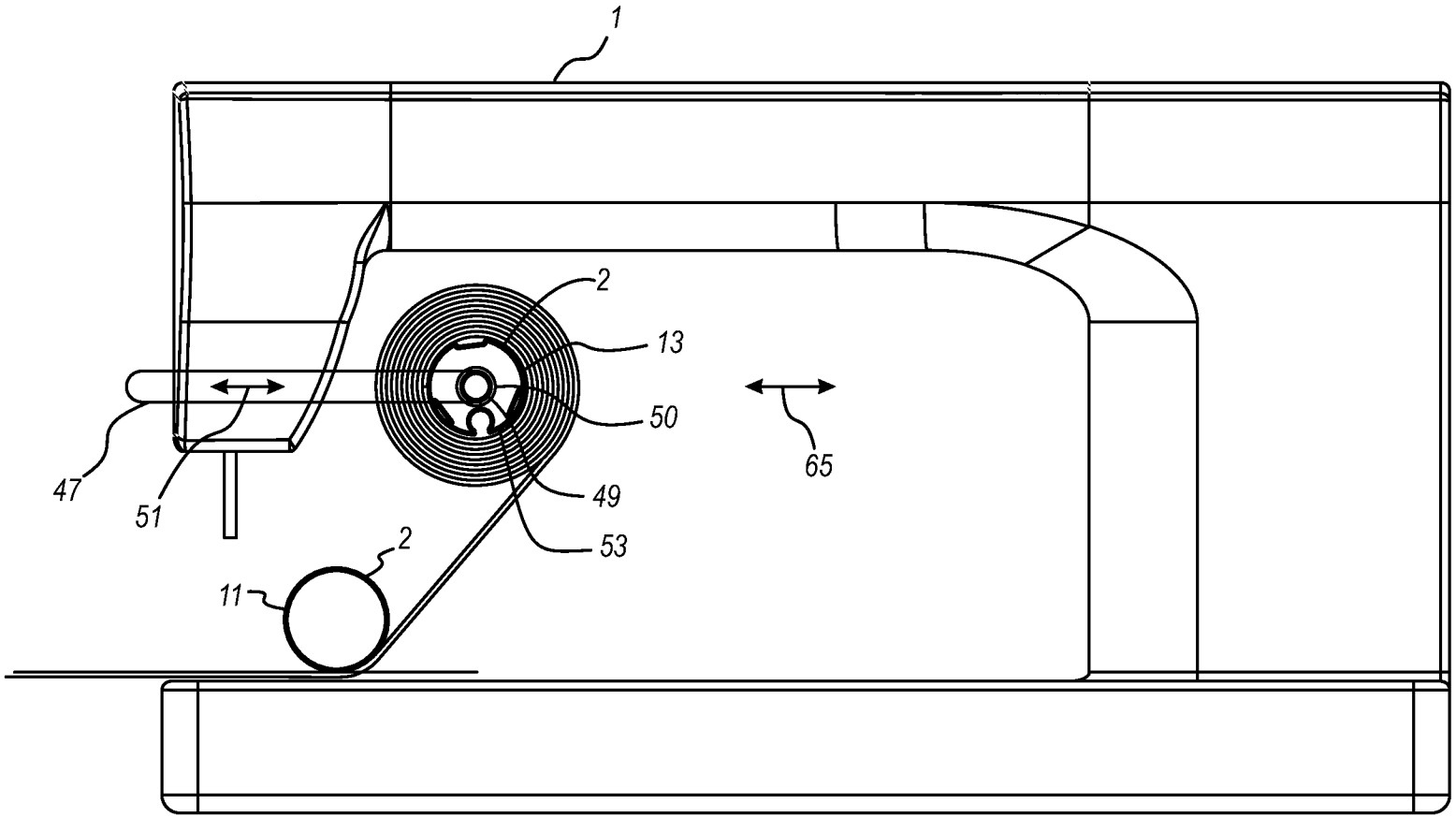
FIG. 10 illustrates a side view cross section of a preferred embodiment of the take-up rail assembly of the present invention having a slide track attached to the quilting frame and the take-up rail having a take-up rail axle which slides longitudinally in the slide track.

Referring now to FIG. 10, a further preferred embodiment of a take-up rail assembly 2 of the present invention is shown. For this embodiment, take-up rail longitudinal movement 65 is provided by the take-up rail axle 50 sliding forward and rearward 51 in a slide track 47 at each end of the take-up rail. The take-up rail assembly 2 is shown with the idler rail 11 near an idler rail full forward position 18 and the take-up rail 13 at a take-up rail full back position 53. Variations of a take-up rail control mechanism which provide for sliding or otherwise moving the take-up rail longitudinally between the full back position and the full forward position, for this embodiment, will be known to persons of ordinary skill in the art, in view of the description and drawings presented in this application. Such take-up rail control mechanisms may include a screw drive, solenoid drive, or pressurized fluid drive.

Figure 11:
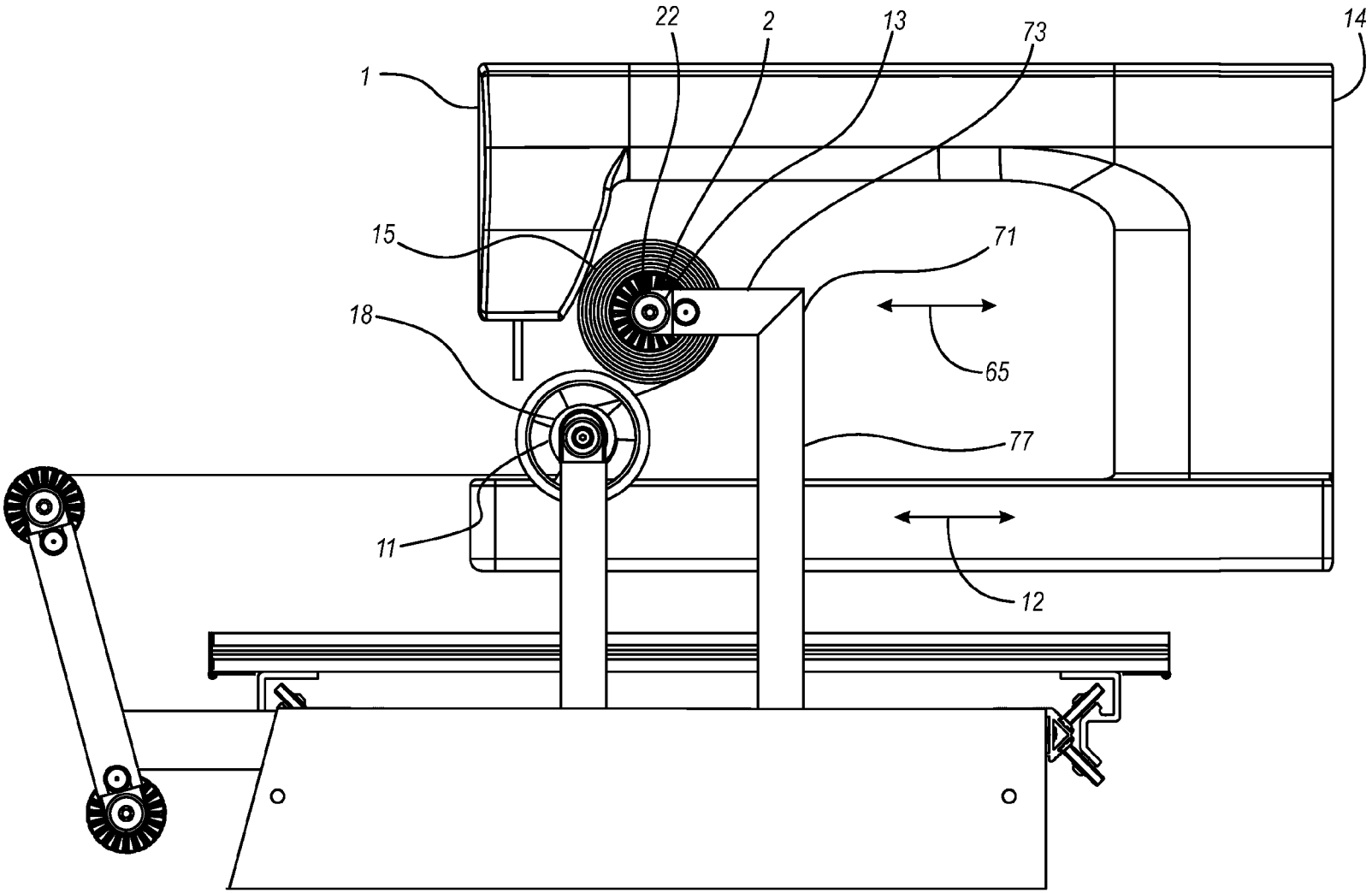
FIG. 11 is a side view of a preferred embodiment of a take-up rail assembly of the present invention deployed with a typical sewing machine, the sewing machine being in a machine full back position, the fixed idler rail being at a fixed rail full forward position, and the take-up rail being at a take-up rail full back position, the take-up rail assembly having a take up rail support member providing for longitudinal movement of the take-up rail.
Figure 12:
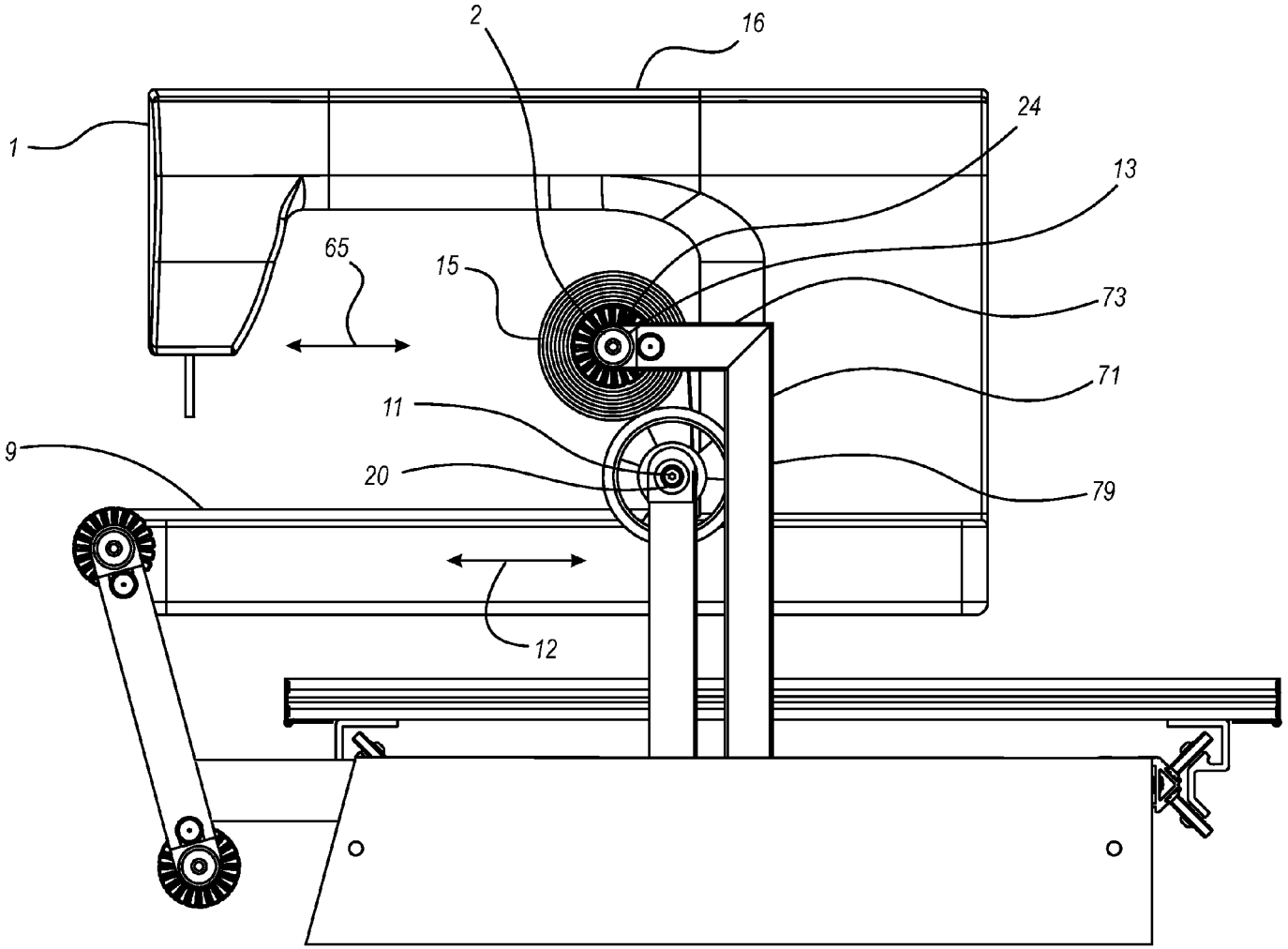
FIG. 12 is a side view of a preferred embodiment of a take-up rail assembly of the present invention deployed with a typical sewing machine, the sewing machine being in a machine full forward position, the fixed idler rail being at a fixed rail full back position, and the take-up rail being at a take-up rail full forward position, the take-up rail assembly having a take up rail support member providing for longitudinal movement of the take-up rail.

Referring now to FIG. 11, a further preferred embodiment of a take-up rail assembly 2 of the present invention is shown. For this embodiment, take-up rail longitudinal movement 65 is provided by forward and rearward movement, with respect to the fixed idler rail 11, of a pair of take-up rail support members 71 to which the take-up rail is attached, one on each end of the take-up rail. The take-up rail assembly 2 is shown with the idler rail 11 near an idler rail full forward position 18 and the take-up rail 13 at a take-up rail full back position 22, with respect to the fixed idler rail 11. Referring also to FIG. 12, the take-up rail assembly 2 is shown with the idler rail 11 near an idler rail full back position 20 and the take-up rail 13 at a take-up rail full forward position 24, with respect to the fixed idler rail 11. The take-up rail support members 71 may have a support member projection 73 which may reduce or eliminate conflict between the idler rail 11 and the take-up rail 13 as the take-up rail 13 moves between the take-up rail full back position 22 and the take-up rail full forward position 24. Alternative embodiments of the support member may simply be curved to provide for the support member projection.

Figure 13:
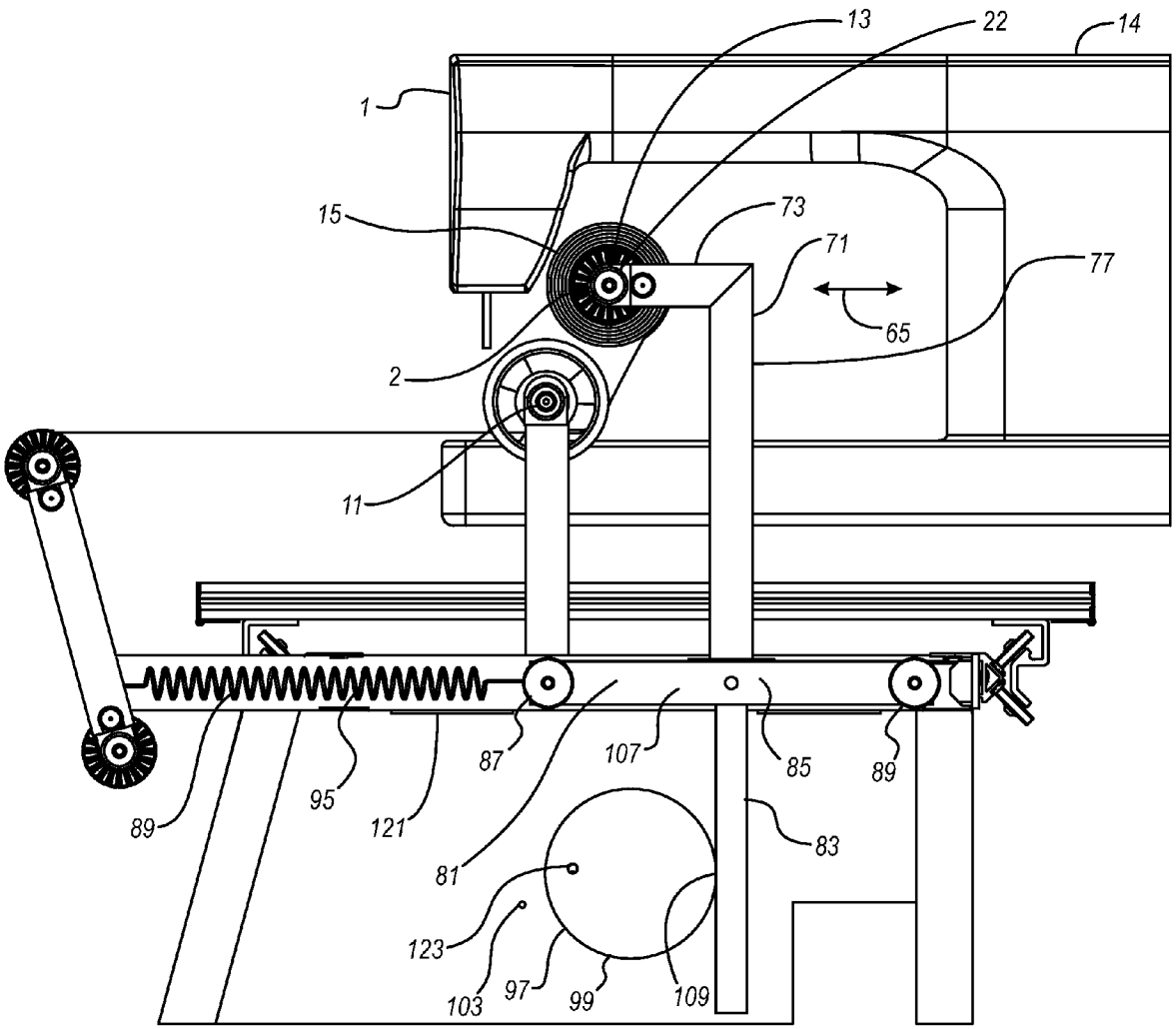
FIG. 13 is a side view cross section of a preferred embodiment of a take-up rail assembly of the present invention shown in FIG. 11, the take up rail support member being attached to an anchor member which is positioned by a take-up cam and a cam spring, providing for longitudinal movement of the take-up rail.

Referring now to FIG. 13, a preferred embodiment of a drive mechanism 85 for the embodiment of the take-up rail assembly 2 of FIG. 11 is shown. For this embodiment, each of the take-up rail support members 71 is attached to an anchor member 81 having a first roller 87 and a second roller 89 which provide for movement of the anchor member 81 on a roll track 121 and for movement of the take-up rail support member 71 between a support member full back position 77 and a support member full forward position 79. A take-up cam 97, which rotates about an offset cam axis 123, may provide for positioning of the anchor member 81 and the support member 71 by cam contact 109 with a cam bar 83 which is connected to the anchor member 81. The take-up cam 97 is shown rotated in FIG. 13 to the cam full back position 99, which provides for the take-up rail support member 71 to be positioned at the support member full back position 77 and for the take-up rail to be positioned at the take-up rail full back position 22.

Figure 14:
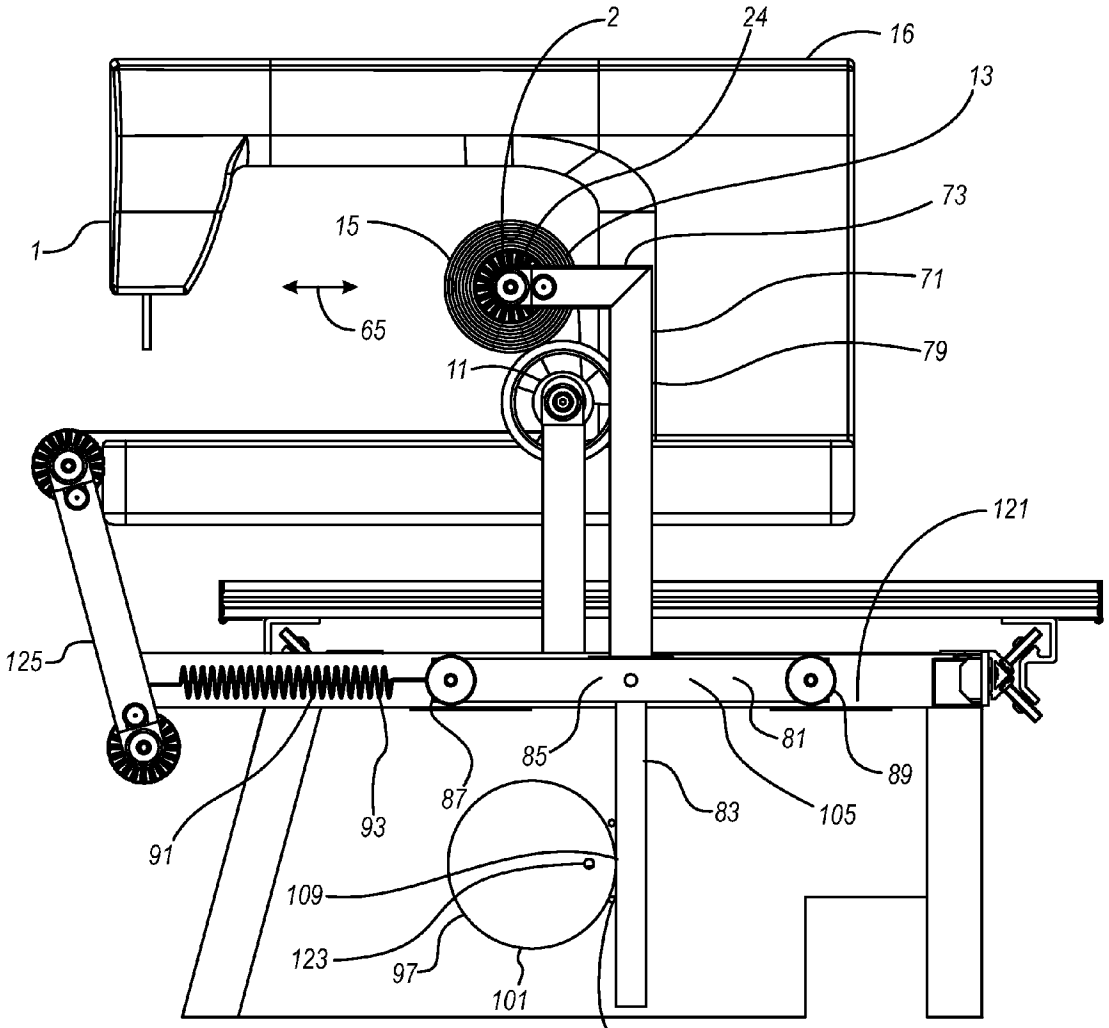
FIG. 14 is a side view cross section of a preferred embodiment of a take-up rail assembly of the present invention shown in FIG. 12, the take up rail support member being attached to an anchor member which is positioned by a take-up cam and a cam spring, providing for longitudinal movement of the take-up rail.

Referring also to FIG. 14, the take-up cam 97 is shown rotated to the cam full forward position 101, which provides for the take-up rail support member 71 to be positioned at the support member full forward position 79 and for the take-up rail to be positioned at the take-up rail full forward position 24. For the embodiment shown in FIG. 13 and FIG. 14, cam contact 109 between the take-up cam 97 and the cam bar 83, is maintained by a cam retainer device, which, for the embodiment shown, is a cam spring 91 which may be attached to an end of the anchor member 81 and to the sewing frame structure 125. The embodiment of the drive mechanism shown in FIG. 13 and FIG. 14 may incorporate a take-up cam 97 at each end of the take-up rail 13 or may utilize a single take-up cam 97 at only one end of the take-up rail 13. Likewise, the embodiment of the drive mechanism shown in FIG. 13 and FIG. 14 may incorporate a cam spring 91 at each end of the take-up rail 13, or may utilize a single cam spring 91 at only one end of the take-up rail 13. Other variations of this embodiment may incorporate a cam pressurized gas cylinder or other device known to persons of skill in the art to maintain contact between the take-up cam 97 and the cam bar 83. Other variations of this embodiment may incorporate a connecting rod between the take-up cam and the cam bar 83, rather than direct cam contact 109, to provide for movement of the take-up rail as the take-up cam 97 rotates. Other variations of this embodiment for connecting the take-up cam 97 to the anchor member 81 will be known to persons of skill in the art in view of the description and drawings of this application.

Figure 15:
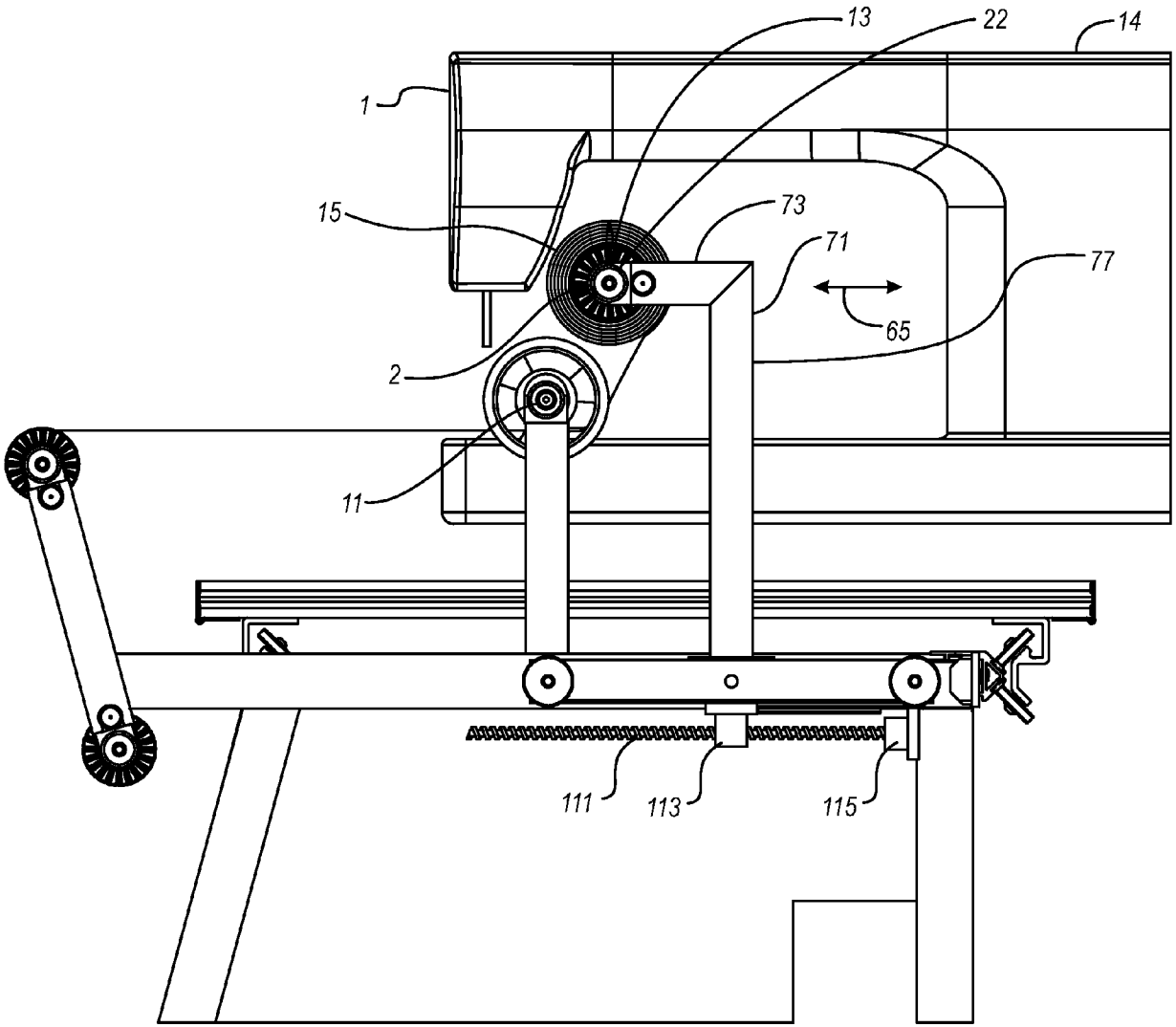
FIG. 15 is a side view cross section of a preferred embodiment of a take-up rail assembly of the present invention shown in FIG. 11, the take up rail support member being attached to an anchor member which is positioned by a screw drive, providing for longitudinal movement of the take-up rail.
Figure 16:
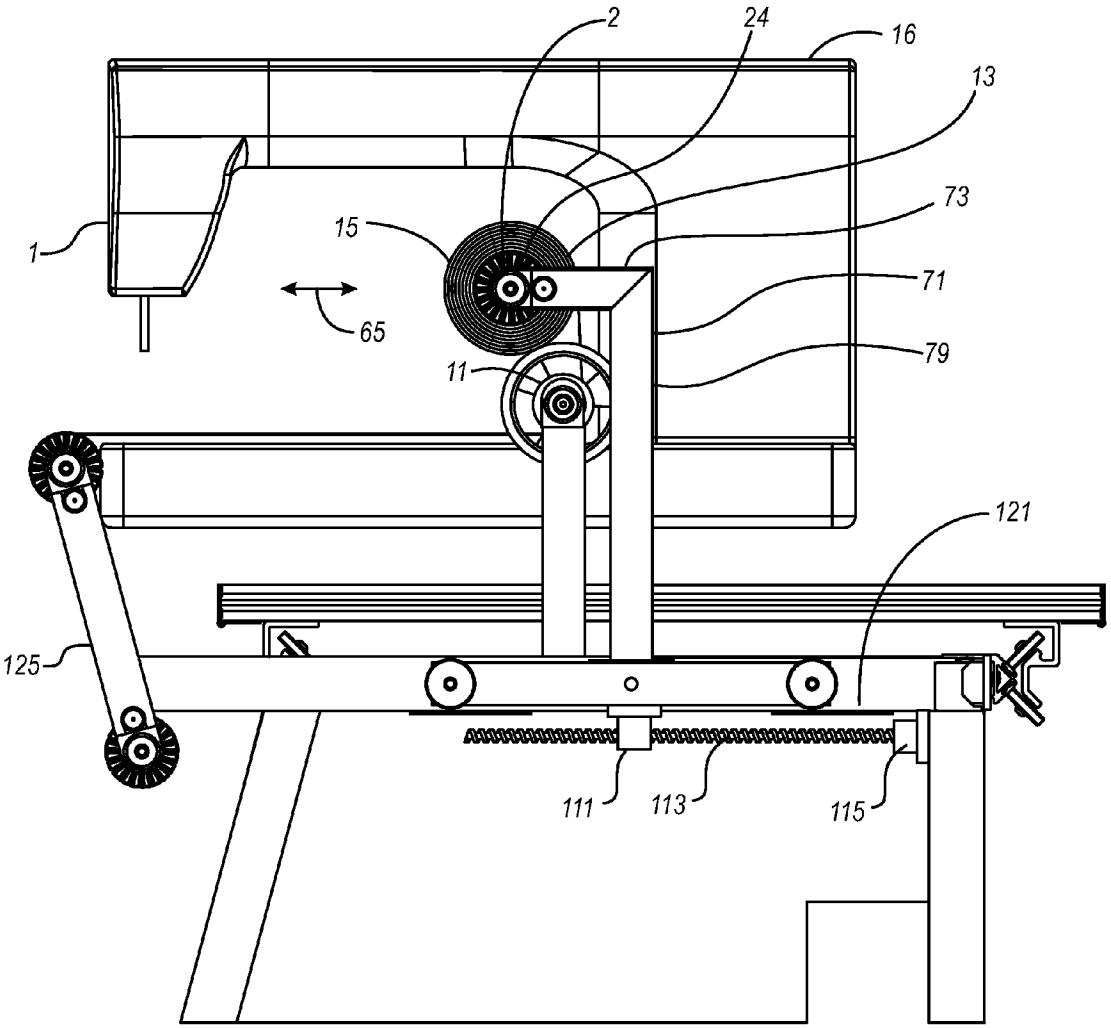
FIG. 16 is a side view cross section of a preferred embodiment of a take-up rail assembly of the present invention shown in FIG. 12, the take up rail support member being attached to an anchor member which is positioned by a screw drive, providing for longitudinal movement of the take-up rail.

Referring now to FIG. 15 and FIG. 16, an alternative preferred embodiment of a drive mechanism 85 for the embodiment of the take-up rail assembly 2 of FIG. 11 is shown. For this embodiment, each of the take-up rail support members 71 is attached to an anchor member 81 having a first roller 87 and a second roller 89 which provide for movement of the anchor member 81 on a roll track 121 and for movement of the take-up rail support member 71 between a support member full back position 77 and a support member full forward position 79. For this embodiment, a screw drive 111 which is rotated by a drive motor 115 and threaded through a screw sleeve 113 which is connected to an anchor member 81 and the take-up rail support member 71, may provide for the desired movement of the take-up rail between the take-up rail full back position 22 shown in FIG. 15 and the take-up rail full forward position shown in FIG. 16. Variations of this embodiment may provide for other structure variations for connecting the screw drive to the anchor member 81 or the take-up rail support member 71. Variations of this embodiment may utilize a single screw drive at one end of the take-up rail or may utilize a screw drive at each end of the take-up rail.

Other embodiments and variations of a take-up rail control mechanism which provide for moving the take-up rail longitudinally between the full back position and the full forward position will be known to persons of ordinary skill in the art, in view of the description and drawings presented in this application. Such take-up rail control mechanisms may utilize a cam drive, a screw drive, a hydraulic ram, a solenoid, or other drive mechanisms known to persons skilled in the art.

Also, as noted above for the embodiments having a pivoting take-up rail, the take-up rail control mechanism may also control the longitudinal movement of the take-up rail based upon contact of the fabric roll 15 with the forward throat edge 5 and the rearward throat edge 7 as shown in FIG. 1 and FIG. 2 respectively.

Embodiments of the take-up rail assembly of the present invention may incorporate an idler rail which is vertically and longitudinally adjustable, allowing the vertical and longitudinal adjustment of the idler rail to match the sewing machine, or the fabric being sewed, or both. Accordingly, where the term "fixed" idler rail is used in this application, the term is defined to include embodiments wherein the user may vertically or longitudinally adjust the position of the idler rail and "fix" the idler rail in the position desired by the user or needed for the sewing machine or fabric, or both, being used.

As noted above, although preferred embodiments of the take-up rail assembly of the present invention are described as attached or attachable to a typical quilting frame, and used for quilting of multiple fabric layers, other embodiments of the take-up rail assembly of the present invention may be attached or attachable to sewing frames used for embroidery or other sewing operations involving a single fabric layer or multiple fabric layers.

The drive mechanism used for the movement of the take-up rail, whether it incorporates a cam drive, screw drive, ratchet drive, solenoid, or other drive mechanism, may use an electric drive motor and a gear mechanism, or other electric actuator. The actuation and control of the drive motor and the gear mechanism, or other electric actuator to accomplish the desired movement of the take-up rail, may be accomplished by a take-up rail control mechanism dedicated to the quilting frame or other sewing frame, or may be accomplished by link to an external computer.

Regardless of the embodiment of the take-up rail control mechanism, it may be linked to a computerized sewing machine control system which controls the movement of the sewing machine on a quilting frame or other sewing frame. The sewing machine control system may also control the longitudinal movement of the take-up rail by the take-up rail control mechanism, based upon the position of the sewing machine with respect to the frame or with respect to the fixed idler rail. Other embodiments of the take-up rail control mechanism, for controlling the longitudinal movement of the take-up rail, will be known to persons of ordinary skill in the art in view of the description and the drawings for the present invention presented for this application.

The drawings and the foregoing description show and describe various preferred embodiments of the take-up rail assembly 2 of the present invention. The embodiments incorporate various embodiments of a take-up rail support structure 131 for movably attaching the take-up rail 13 to the sewing frame 34, for supporting the take-up rail in its various positions, and providing for longitudinal movement of the take-up rail as driven by the drive mechanism and controlled by the take-up rail control mechanism. Other embodiments of the take-up rail support structure providing for support and movement of the take-up rail as driven by the drive mechanism and controlled by the take-up rail control mechanism, will be known to persons of ordinary skill in the art, in view of the drawings and description of the present invention presented in this application.

For clarification, the term "take-up rail control mechanism" shall be defined to include the drive mechanism which provides the force for the movement of the take-up rail and positions the take up rail as directed by the take-up rail control mechanism. The take-up rail control mechanism transmits a control signal to the drive mechanism which causes to drive mechanism to position the take-up rail by interaction with the take-up rail support structure or directly with the take-up rail. The take-up rail control system may provide for input by the user, such as maximum fabric roll diameter, sewing machine make and model, or sewing machine throat length. The sewing machine control mechanism may be a dedicated control system or may depend on interface with an external computer for input of control parameters or signals.

Other embodiments and other variations and modifications of the embodiments described above will be obvious to a person skilled in the art. Therefore, the foregoing is intended to be merely illustrative of the invention and the invention is limited only by the following claims and the doctrine of equivalents.

What is claimed is:

1. A sewing machine take-up rail assembly for a sewing frame, the take-up rail assembly comprising:

a fixed idler rail attachable to the sewing frame;

a take-up rail movably attachable to the sewing frame by a take-up rail support structure comprising a pair of take-up rail support members, a pair of anchor members, and a pair of roller tracks, each anchor member having two or more rollers, each anchor member being attached to a respective take-up rail support member, the rollers providing for longitudinal movement of the anchor members, the take-up rail support members, and the take-up rail, by a rolling of the rollers respectively in the respective roller tracks; and a take-up rail control mechanism for controlling the longitudinal movement of the take-up rail with respect to the fixed idler rail by controlling the longitudinal movement of the take-up rail support members and the anchor members with respect to the fixed idler rail as a sewing machine moves with respect to the sewing frame.

2. A sewing machine take-up rail assembly as recited in claim 1 further comprising a generally vertical cam bar attached to one of the anchor members, a take-up rail cam, and a cam retainer device for maintaining contact between the cam bar and the take-up rail cam.

3. A sewing machine take-up rail assembly as recited in claim 2 wherein the cam retainer device comprises a cam spring which is attachable to the anchor member and to the sewing frame.

4. A sewing machine take-up rail assembly for a sewing frame, the take-up rail assembly comprising:

a fixed idler rail attachable to the sewing frame;

a take-up rail pivotally attachable to the sewing frame by a pair of pivot arms, each pivot arm pivotally attaching an end of the take-up rail to the sewing frame; and a take-up rail control mechanism for controlling a longitudinal movement of the take-up rail with respect to the fixed idler rail, the take-up rail control mechanism being attachable to one of the pivot arms and controlling the pivoting of the take-up rail by controlling the pivoting of the pivot arm as a sewing machine moves with respect to the sewing frame.

5. A sewing machine take-up rail assembly for a sewing frame, the take-up rail assembly comprising:

a fixed idler rail attachable to the sewing frame;

a take-up rail support structure comprising a pair of take-up rail support members, a pair of anchor members, and a pair of roller tracks, each anchor member having two or more rollers, each anchor member being attached to a respective take-up rail support member, the rollers providing for longitudinal movement of the anchor members, and the take-up rail support members by a rolling of the rollers respectively in the respective roller tracks;

a take-up rail movably attachable to the sewing frame by the take-up rail support structure, the take-up rail support structure providing for longitudinal movement of the take-up rail; and a take-up rail control mechanism for controlling the longitudinal movement of the take-up rail by controlling the longitudinal movement of the take-up rail support members and the anchor members with respect to the fixed idler rail as a sewing machine moves with respect to the sewing frame, the take-up rail control mechanism including a take-up rail cam.

6. A sewing machine take-up rail assembly as recited in claim 5 further comprising a generally vertical cam bar attached to one of the anchor members, a take-up rail cam, and a cam retainer device for maintaining contact between the cam bar and the take-up rail cam.

7. A sewing machine take-up rail assembly as recited in claim 6 wherein the cam retainer device comprises a cam spring which is attachable to the anchor member and to the sewing frame.

* * * * *